US012752962B1

(12) United States Patent
Tang

(10) Patent No.: US 12,752,962 B1
(45) Date of Patent: Oct. 6, 2026

(54) STORAGE BOX

(71) Applicant: Juhui Tang, Jiangmen (CN)

(72) Inventor: Juhui Tang, Jiangmen (CN)

( * ) Notice: Subject to any disclaimer, the term of this patent is extended or adjusted under 35 U.S.C. 154(b) by 0 days.

(21) Appl. No.: 19/294,288

(22) Filed: Aug. 8, 2025

(30) Foreign Application Priority Data

Jul. 22, 2025 (CN) ..... 202521541747.8

(51) Int. Cl.

| | |
|---|---|
| ***B65D 6/02*** | (2006.01) |
| ***B65D 43/16*** | (2006.01) |
| ***B65D 43/26*** | (2006.01) |
| ***B65D 45/02*** | (2006.01) |
| ***B65D 55/14*** | (2006.01) |

(52) U.S. Cl.
CPC ..... *B65D 7/06* (2013.01); *B65D 43/167* (2013.01); *B65D 43/267* (2013.01); *B65D 45/02* (2013.01); *B65D 55/14* (2013.01)

(58) Field of Classification Search
CPC ..... B65D 7/06; B65D 43/167; B65D 43/267; B65D 45/02; B65D 55/14
USPC ..... 220/830, 833
See application file for complete search history.

(56) References Cited

U.S. PATENT DOCUMENTS 1,277,918 A * 9/1918 Harris ..... E05D 13/12 220/830
2,483,947 A * 10/1949 Alonzo ..... E05F 1/1058 217/60 C
3,001,227 A * 9/1961 Long ..... A47L 15/4261 217/60 D
4,375,863 A * 3/1983 Kappler ..... B65D 43/164 220/264
6,588,624 B1 * 7/2003 Connors ..... E05F 1/1215 220/827
7,350,664 B2 * 4/2008 Nam ..... E05F 1/12 220/264
8,141,759 B2 * 3/2012 Lota ..... B60R 7/06 220/827
8,887,950 B2 * 11/2014 Salciarini ..... A45D 40/221 220/264
8,967,425 B2 * 3/2015 Lee ..... G03B 17/02 220/831
2003/0000955 A1 * 1/2003 Lee ..... A23B 7/0425 220/848
2005/0133507 A1 * 6/2005 Tanaka ..... B65D 43/26 220/827
2007/0205208 A1 * 9/2007 Ueda ..... G03B 17/02 220/830

(Continued)

FOREIGN PATENT DOCUMENTS

JP H08184237 A * 7/1996 ..... E05B 77/06

*Primary Examiner* — Orlando E Aviles
*Assistant Examiner* — Niki M Eloshway

(57) ABSTRACT

A storage box includes a cover body, a box body, and at least one transmission assembly. The cover body and the box body are configured to open and close relative to each other. At least one transmission assembly is arranged in the box body. The at least one transmission assembly includes a first end and a second end. The first end and the second end are arranged in a force-transmissible relationship. During a closing process of the cover body, the cover body acts on the first end, and the second end of the at least one transmission assembly pulls the cover body, enabling the cover body to abut against the box body.

20 Claims, 14 Drawing Sheets

(56) References Cited

U.S. PATENT DOCUMENTS

2015/0021347 A1* 1/2015 Yoshida ..... A45D 40/221
220/831

* cited by examiner

STORAGE BOX

CROSS REFERENCE TO RELATED APPLICATIONS

This application claims priority to the Chinese patent application No. 202521541747.8, filed on Jul. 22, 2025, the disclosure of which is incorporated by reference herein in its entirety.

FIELD OF THE DISCLOSURE

The disclosure relates generally to the field of storage devices. More specifically, the disclosure relates to the field of a storage box.

BACKGROUND

A cover body of a flip-top storage box can usually rotate open and close relative to the box body. Since it is necessary to ensure a movable space for the cover body to rotate relative to the box body, a gap will be left between the cover body and the box body, and others can pry open the storage box along the gap from outside, which leads to poor safety performance. Therefore, it is necessary to improve the storage box in some related art to avoid the above-mentioned defects.

SUMMARY

The following presents a simplified summary of the disclosure in order to provide a basic understanding of some aspects of the disclosure. This summary is not an extensive overview of the disclosure. It is not intended to identify critical elements or to delineate the scope of the disclosure. Its sole purpose is to present some concepts of the disclosure in a simplified form as a prelude to the more detailed description that is presented elsewhere.

In some embodiments, a storage box is provided. The storage box includes a cover body, a box body, and at least one transmission assembly. The cover body and the box body are configured to open and close relative to each other. At least one transmission assembly is arranged in the box body. The at least one transmission assembly includes a first end and a second end. The first end and the second end are arranged in a force-transmissible relationship. During a closing process of the cover body, the cover body acts on the first end, and the second end of the at least one transmission assembly pulls the cover body, enabling the cover body to abut against the box body.

BRIEF DESCRIPTION OF THE DRAWINGS

Illustrative embodiments of the present disclosure are described in detail below with reference to the attached drawing figures.

REFERENCE NUMERALS IN THE DRAWINGS

Figure 1:
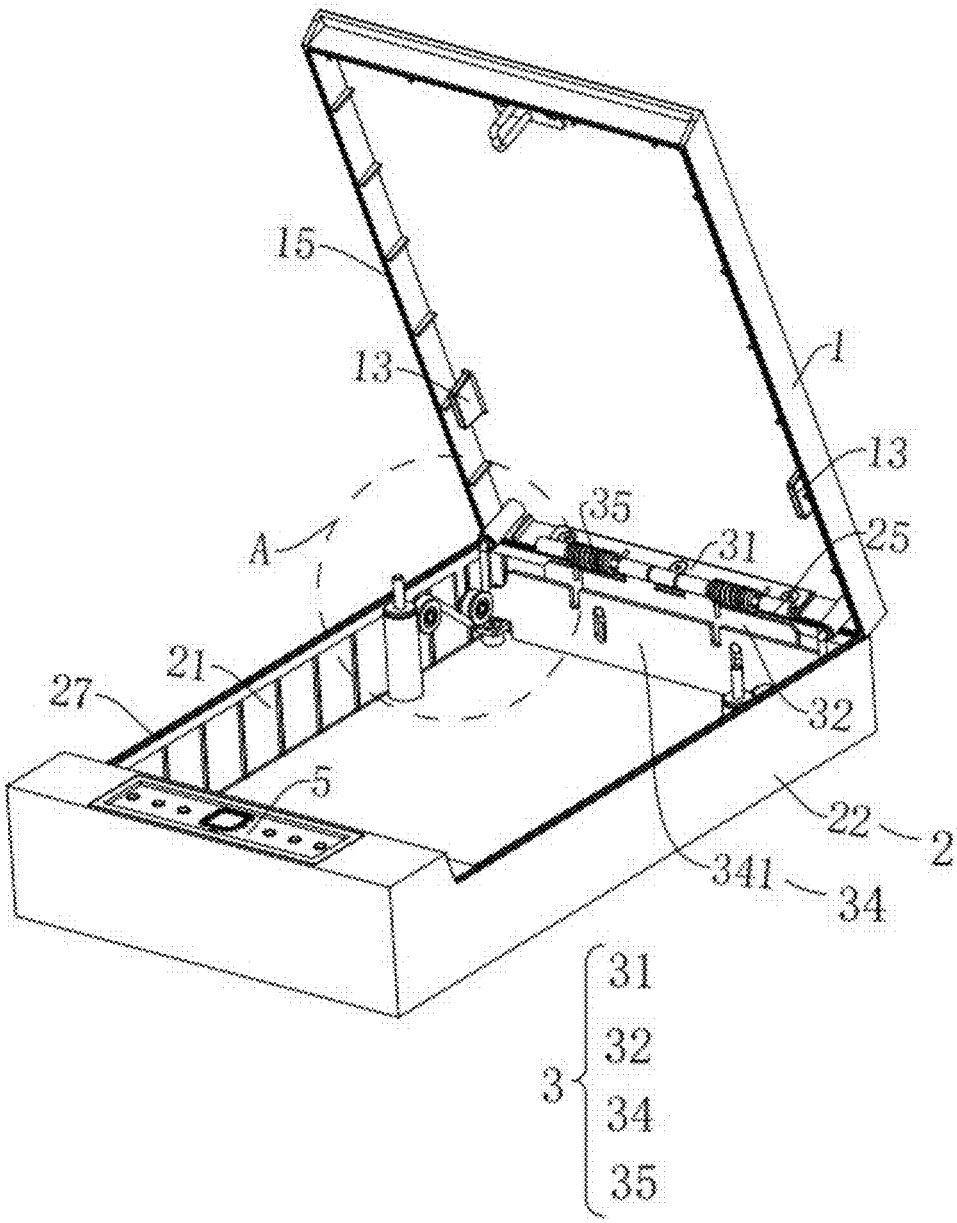
FIG. 1 shows a structural view of a storage box according to an embodiment of the disclosure.

1—cover body; 11—first end wall; 12—receiving column; 13—pressing member; 14—upper stop; 15—lower edge;

2—box body; 21—first side wall; 22—second side wall; 23—lower stop; 24—second end wall; 25—gap; 26—positioning post; 27—upper edge;

3—hinge; 31—first connecting portion; 32—second connecting portion; 321—protruding post; 322—hook-shaped member; 33—rotating shaft; 34—limiting member; 341—limiting plate; 343—opening; 35—torsion spring; 351—first arm; 352—second arm;

4—transmission assembly; 41—first end; 42—second end; 43—bearing member; 431—first connection end; 432—sleeve; 4321—receiving cavity; 433—pressing rod; 434—elastic member; 435—lever; 436—connecting shaft; 44—conversion member; 441—second connection end; 442—flexible connecting member; 443—steering member; 4431—steering wheel; 4432—limiting shaft; 444—crankshaft; 445—connecting member; 446—guide rod;

5—locking member.

DETAILED DESCRIPTION

The following describes some non-limiting exemplary embodiments of the disclosure with reference to the accompanying drawings. The described embodiments are merely a part rather than all of the embodiments of the disclosure. All other embodiments obtained by a person of ordinary skill in the art based on the embodiments of the disclosure shall fall within the scope of the disclosure.

It should be noted that the terms “first”, “second”, etc. in the description, claims, and accompanying drawings of the present disclosure are used to distinguish similar objects, and are not necessarily used to describe a specific order or sequence. It should be understood that the data used in this way can be interchanged in appropriate circumstances, so that the embodiments of the present disclosure described herein can be implemented in an order other than those illustrated or described herein.

In the description of the present disclosure, it should be noted that unless otherwise clearly specified and defined, the terms “arrange”, “mount”, “interconnect”, and “connect” should be understood in a broad sense. For example, it can be a fixed connection, a detachable connection, or an integrated connection; it can be a mechanical connection; it can be directly connected, or indirectly connected through an intermediate medium, or it can be a communication between two elements. For those skilled in the art, the specific meaning of the above terms in the present disclosure can be understood in specific circumstances.

In the description of this specification, reference to terms such as "example", "an example", and "an embodiment" means that the specific features, structures, materials, or characteristics described in conjunction with the embodiment or embodiment are included in at least one embodiment or illustrated embodiment of the present disclosure. In this specification, the illustrative statements of the above terms do not necessarily refer to the same embodiment or embodiment. Moreover, the described specific features, structures, materials, or characteristics can be combined in any one or more embodiments or embodiments in a suitable manner.

The present disclosure will be described in detail below with reference to the accompanying drawings.

In order to solve the above technical problems, referring to FIGS. 1, 2, 4, 5, 8, and 9, an embodiment of the present disclosure provides a storage box. The storage box may include a cover body 1, a box body 2, and at least one transmission assembly 4. The cover body 1 may rotate open and close relative to the box body 2. The transmission assembly 4 may include a first end 41 and a second end 42, and the first end 41 and the second end 42 may be arranged in a force-transmissible relationship. During a closing process of the cover body 1, the cover body 1 may act on the first end 41 of the transmission assembly 4, and the first end 41 of the transmission assembly 4 may convert and transmit a force of the cover body 1 to the second end 42, and the second end 42 may pull the cover body 1, so that a lower edge 15 of the cover body 1 may abut against an upper edge 27 of the box body 2. Each of the lower edge 15 of the cover body 1 and the upper edge 27 of the box body 2 may be formed as a plane, and thus the lower edge 15 and the upper edge 27 may abut against each other for a tight closure. In other embodiments, each the lower edge 15 of the cover body 1 and the upper edge 27 of the box body 2 may be formed with a stop member for staggered abutment. The second end 42 pulling the cover body 1 may be that the second end 42 may be directly connected to the cover body 1 for a direct pulling, or the second end 42 may be connected to the cover body 1 through other members for an indirect pulling, as long as the second end 42 may pull the cover body 1. The transmission assembly 4 may continuously tighten the cover body 1 after the cover body 1 is closed, eliminating a gap between the cover body 1 and the box body 2 to prevent others from prying open the storage box from outside, thereby improving a safety performance of the storage box.

In one embodiment of the present disclosure, as shown in FIGS. 1, 2, 4, 5, 8, and 9, the first end 41 of the transmission assembly 4 may be arranged on a pressing path of the cover body 1. When a user applies a force to move and close the cover body 1 along the pressing path, the cover body 1 may apply a downward pressure to the first end 41 of the transmission assembly 4. The transmission assembly 4 may realize a force conversion and transmission. Specifically, the transmission assembly 4 may convert the downward pressure applied to the first end 41 of the transmission assembly 4 to a pulling force acting on the cover body 1 by the second end 42, by changing a direction of the downward pressure and transmitting the downward pressure to the second end 42 through internal structures, such as lever mechanisms, gear racks, linkage mechanisms, fixed pulley mechanisms, or other mechanical linkage devices. It may be understood that any structure that may convert the downward pressure of the cover body 1 to the pulling force on the cover body 1 falls within the protection scope of the present disclosure and will not be specifically described herein.

In one embodiment of the present disclosure, as shown in FIGS. 1, 2, 3, 4, 5, 6, 8, and 9, two transmission assemblies 4 may be provided. The box body 2 may include a first side wall 21 and a second side wall 22. The first side wall 21 and the second side wall 22 are arranged along a length direction of the box body 2. One of the two transmission assemblies 4 is arranged close to the first side wall 21, and the other of the two transmission assemblies 4 is arranged close to the second side wall 22. Mounting positions of the two transmission assemblies 4 may fully utilize rigid support areas of the first side wall 21 and the second side wall 22 of the box body 2, avoiding occupying a central space of the box body 2, which may be used to store items such as pistols, wallets, etc., thereby optimizing a space utilization rate of the storage box.

Figure 14:
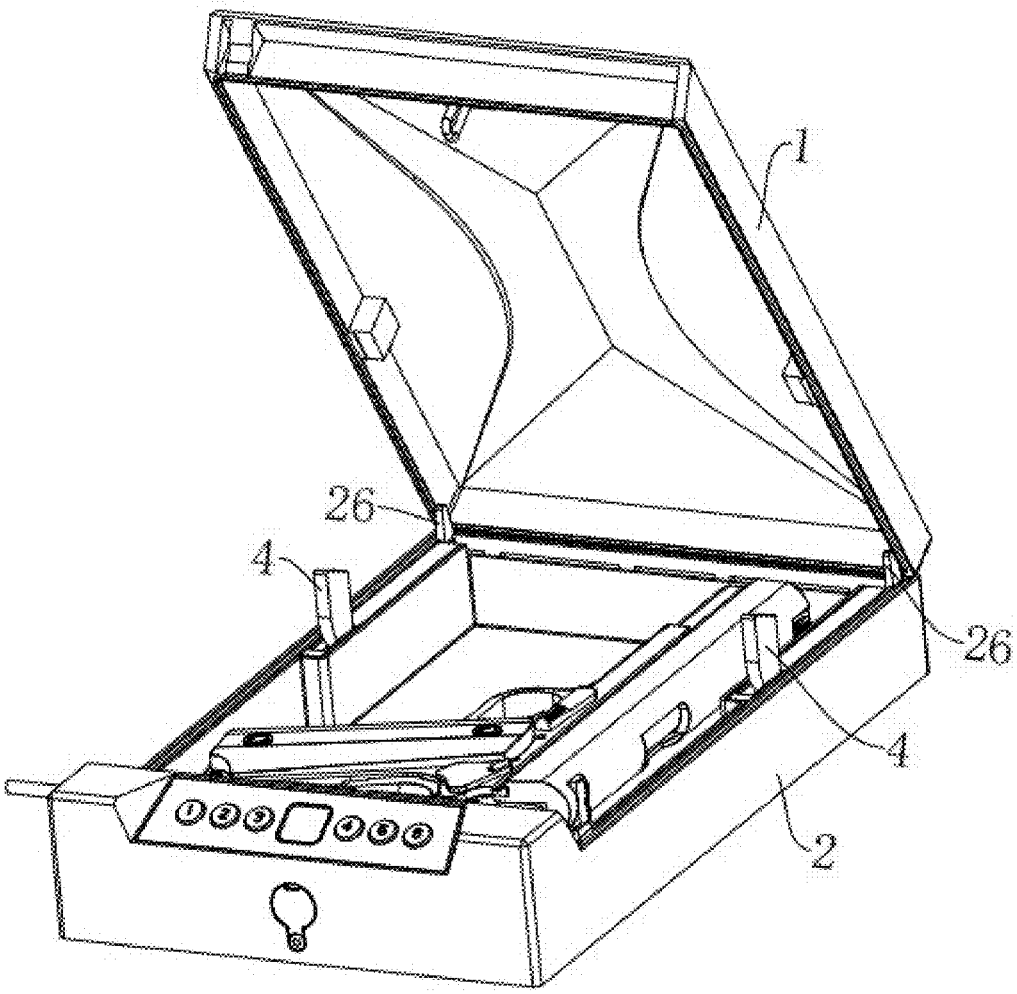
FIG. 14 shows a structural view of another storage box according to an embodiment of the disclosure.

In one embodiment of the present disclosure, as shown in FIG. 14, when the two transmission assemblies 4 are provided, the hinge 3 or other physical connecting structures described below may not be provided between the cover body 1 and the box body 2. During a process of the user operating the cover body 1 to open or close the storage box, the two transmission assemblies 4 may guide and limit the cover body 1 by applying the pulling force, so that the cover body 1 may move along a rotation opening and closing trajectory. When the user opens the cover body 1, the cover body 1 may also be smoothly rotated and closed. In order to further enhance stability of the cover body 1 during rotation, two positioning posts 26 may also be arranged at two edges of the box body 2 near the cover body 1 in a one-to-one correspondence. When the cover body 1 is in an open state, the two positioning posts 26 may be located in an interior space of the cover body 1. Specifically, during an opening process of the cover body 1, each of the two transmission assemblies 4 may apply an oblique downward pulling force to the cover body 1, effectively preventing the cover body 1 from moving backward and dislocating. During the closing process of the cover body 1, the two positioning posts 26 may resist the cover body 1 backward, preventing the cover body 1 from moving forward and dislocating. Therefore, the two transmission assemblies 4 and the two positioning posts 26 may cooperatively guide and limit a movement trajectory of the cover body 1 in a rotation direction, preventing the cover body 1 from shifting.

Figure 2:
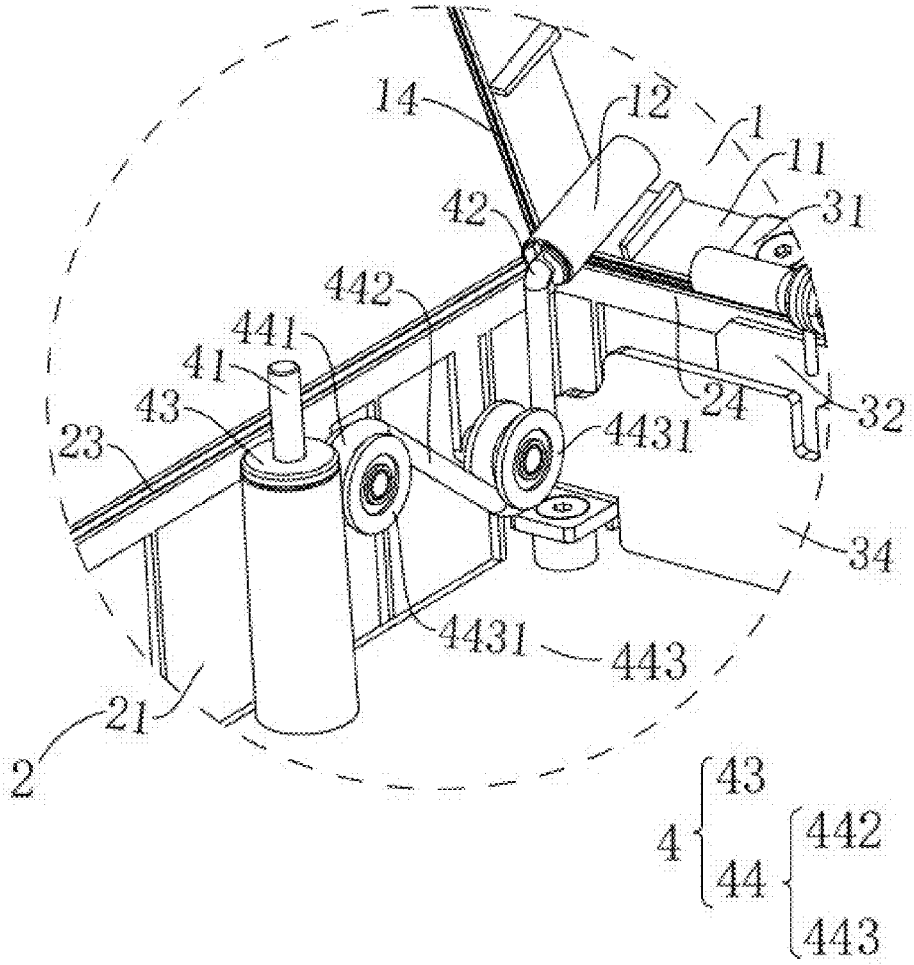
FIG. 2 shows an enlarged view of a portion A in FIG. 1.
Figure 3:
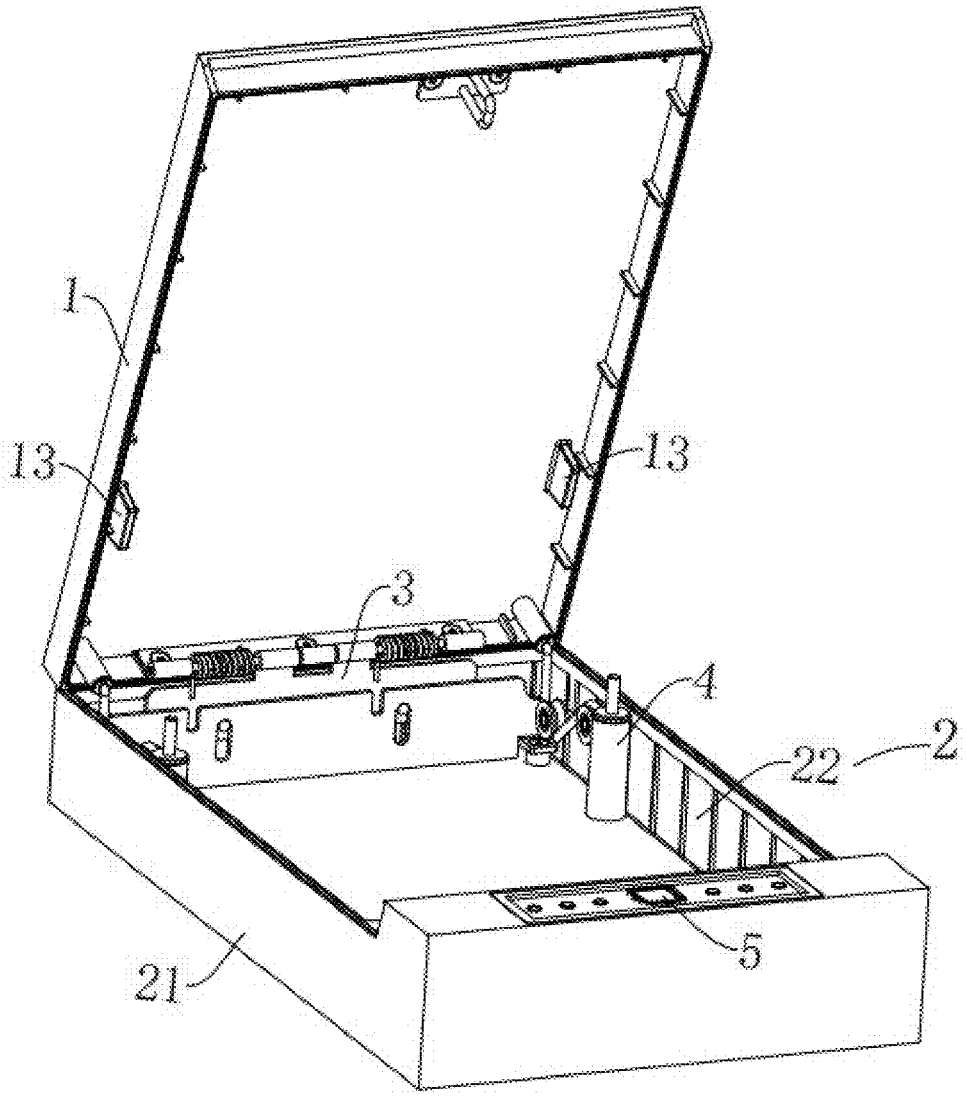
FIG. 3 shows a structural view of the storage box in FIG. 1 from another perspective.
Figure 5:
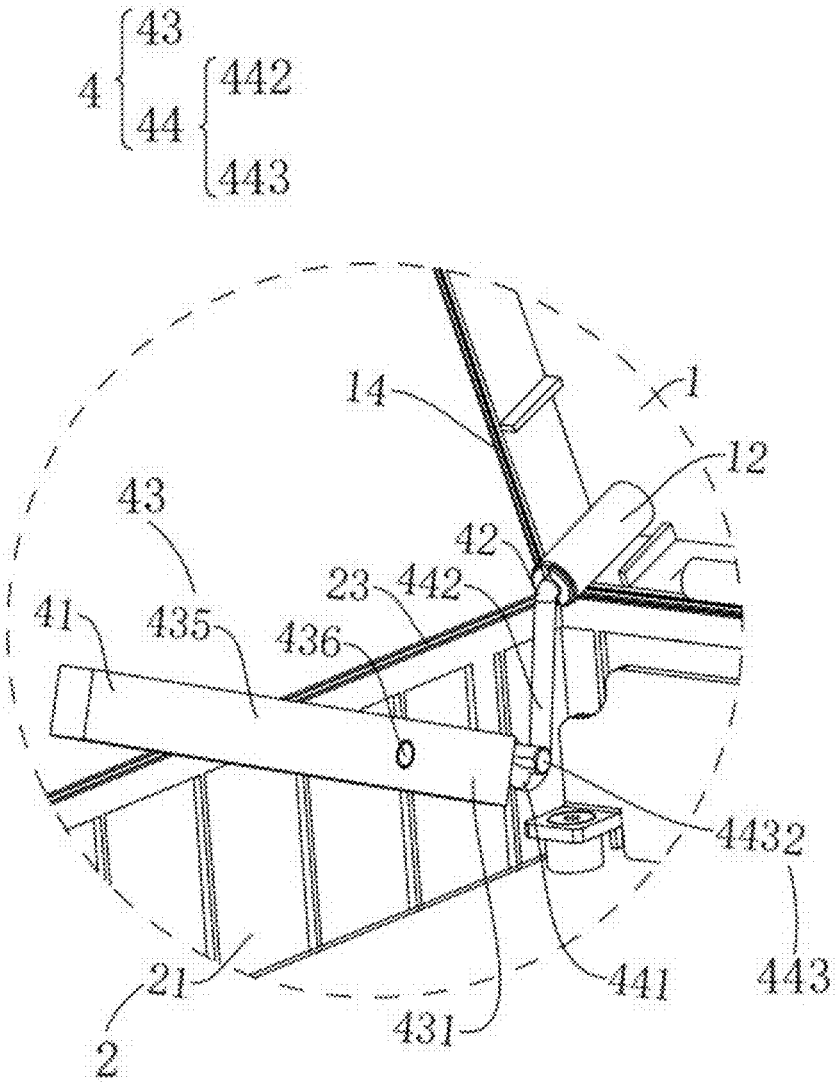
FIG. 5 shows an enlarged view of a portion B in FIG. 4.
Figure 6:
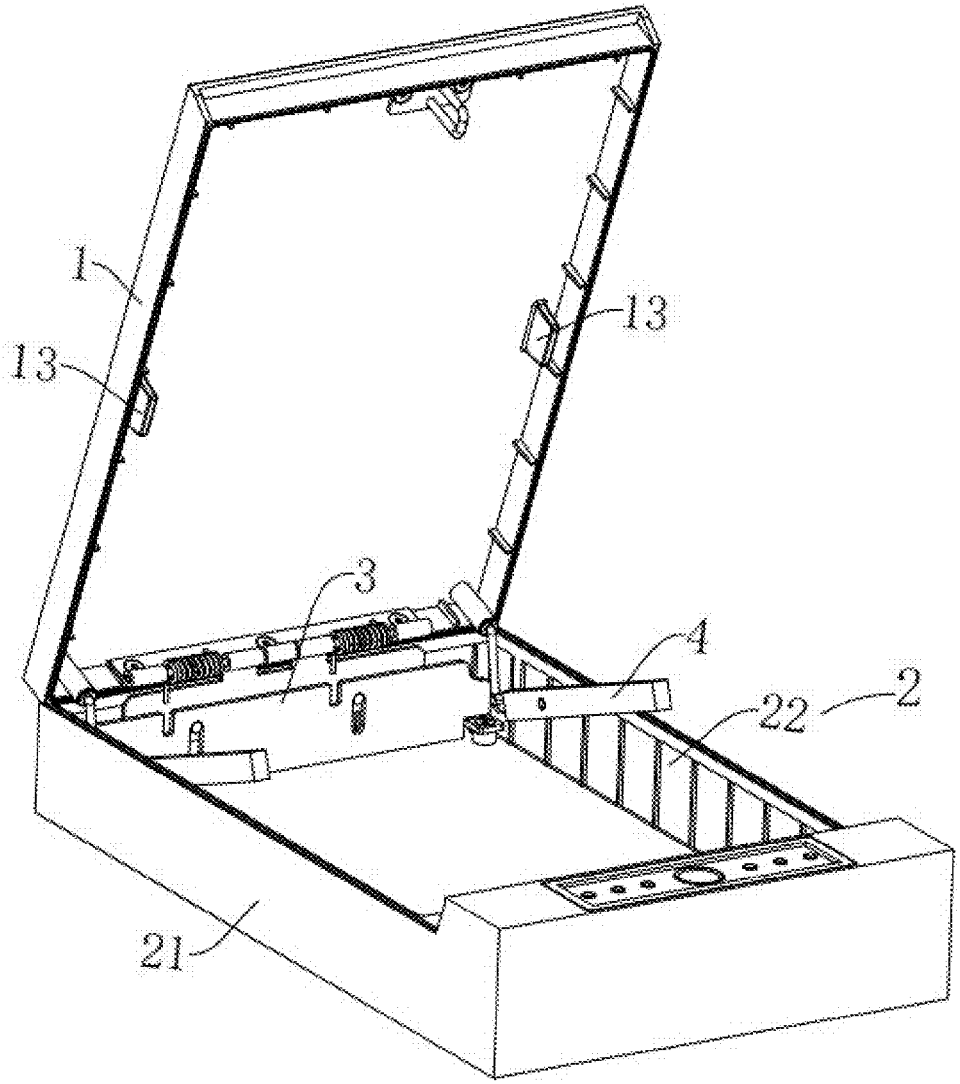
FIG. 6 shows a structural view of the storage box in FIG. 4 from another perspective.
Figure 10:
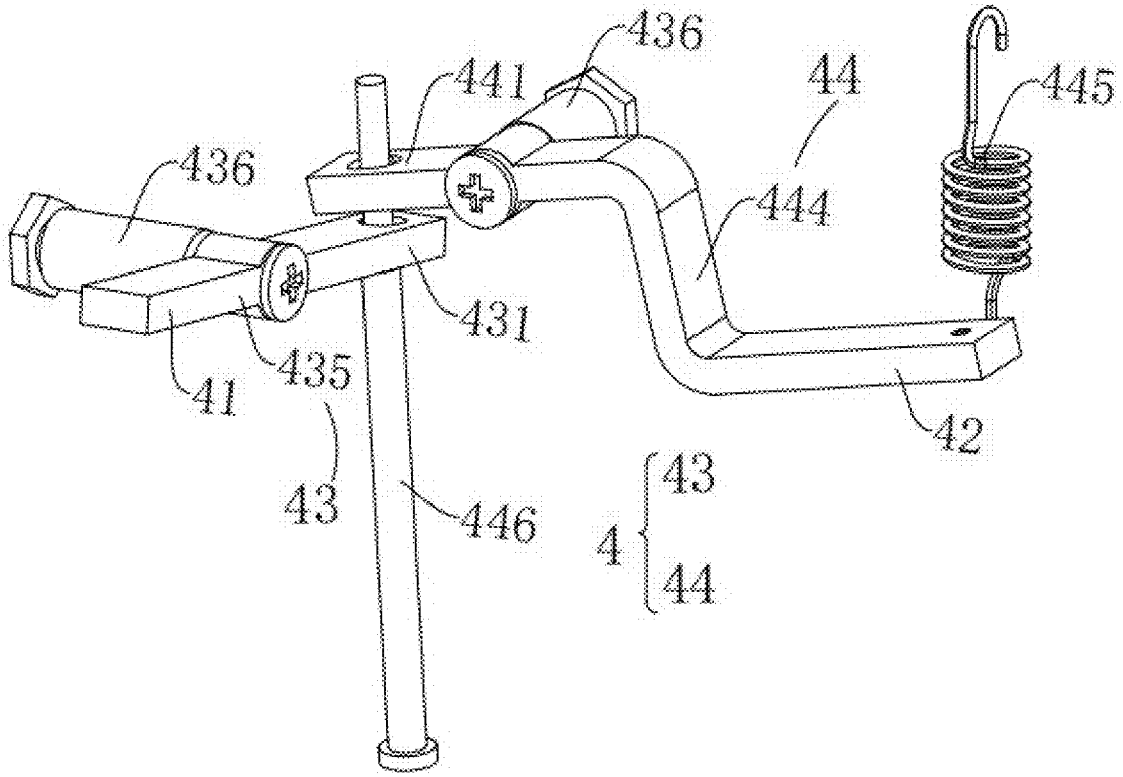
FIG. 10 shows a structural view of a conversion member in FIG. 9.

In one embodiment of the present disclosure, as shown in FIGS. 2, 5, and 10, the transmission assembly 4 may include a bearing member 43 and a conversion member 44. The bearing member 43 may include the first end 41 and a first connection end 431. That is, the first end 41 may be one end of the bearing member 43. The conversion member 44 may include a second connection end 441 and the second end 42. That is, the second end 42 may be one end of the conversion member 44. The second connection end 441 may be connected to the first connection end 431. When the cover body 1 presses down on the first end 41 of the bearing member 43, the first end 41 may generate the downward pressure, and the first connection end 431 may output a corresponding force. The force-transmitting converter 44 may serve as a force conversion mechanism where the first connecting end 431 may drive the second connecting end 441 to move, thereby actuating the second end 42 to pull down the cover 1.

Figure 7:
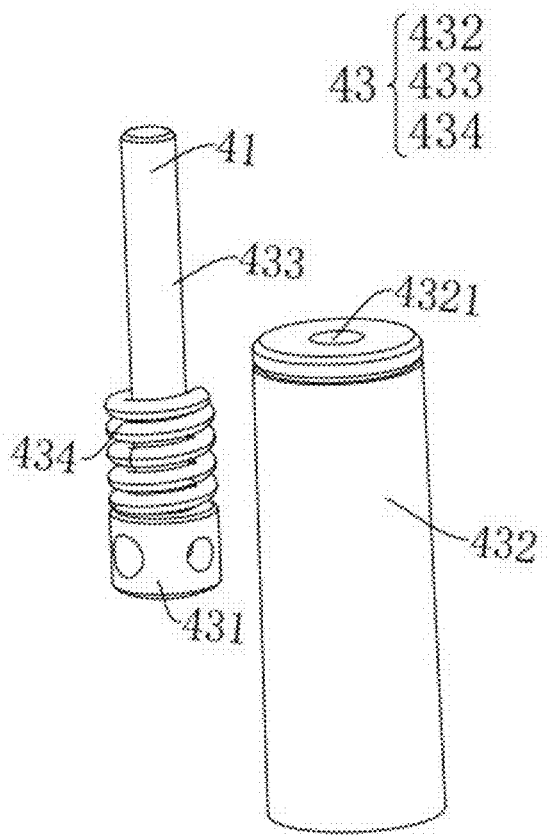
FIG. 7 shows an exploded view of a bearing member in FIG. 2.
Figure 8:
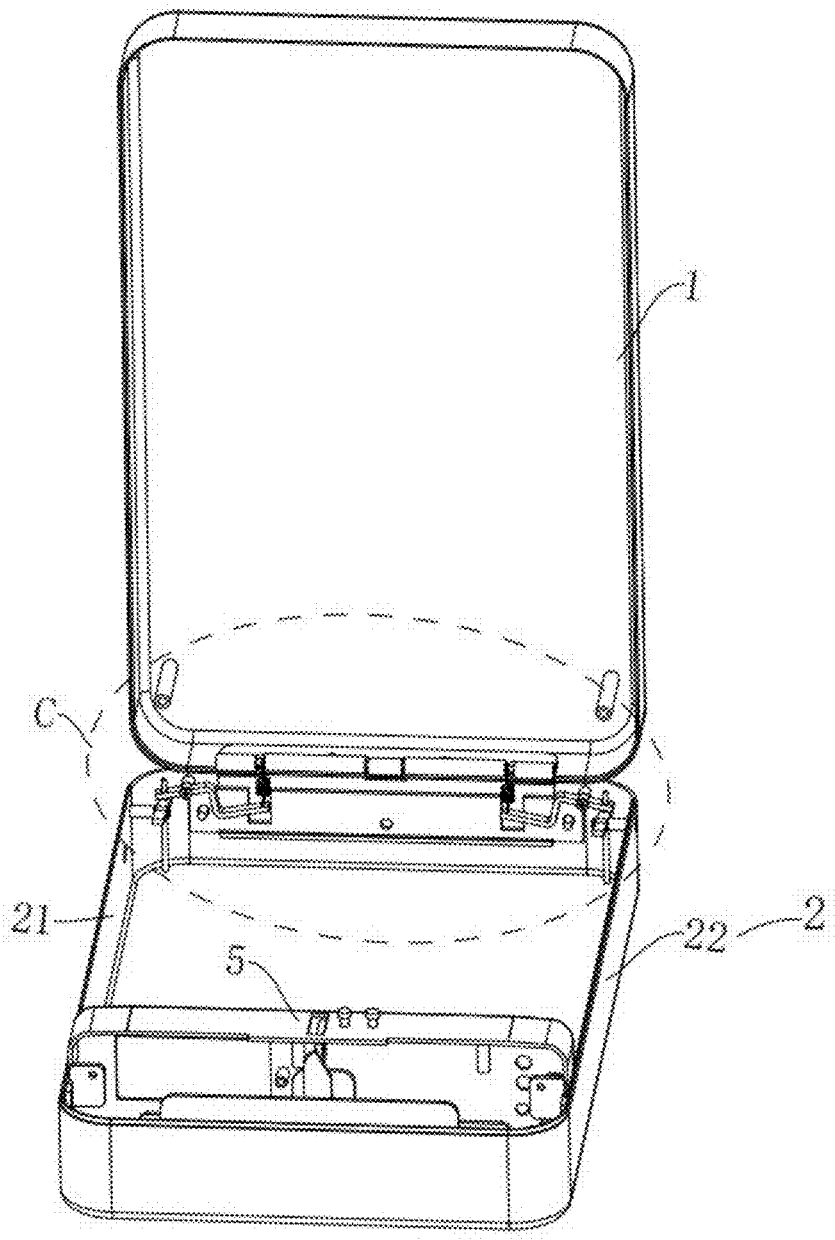
FIG. 8 shows a structural view of another storage box according to an embodiment of the disclosure.
Figure 9:
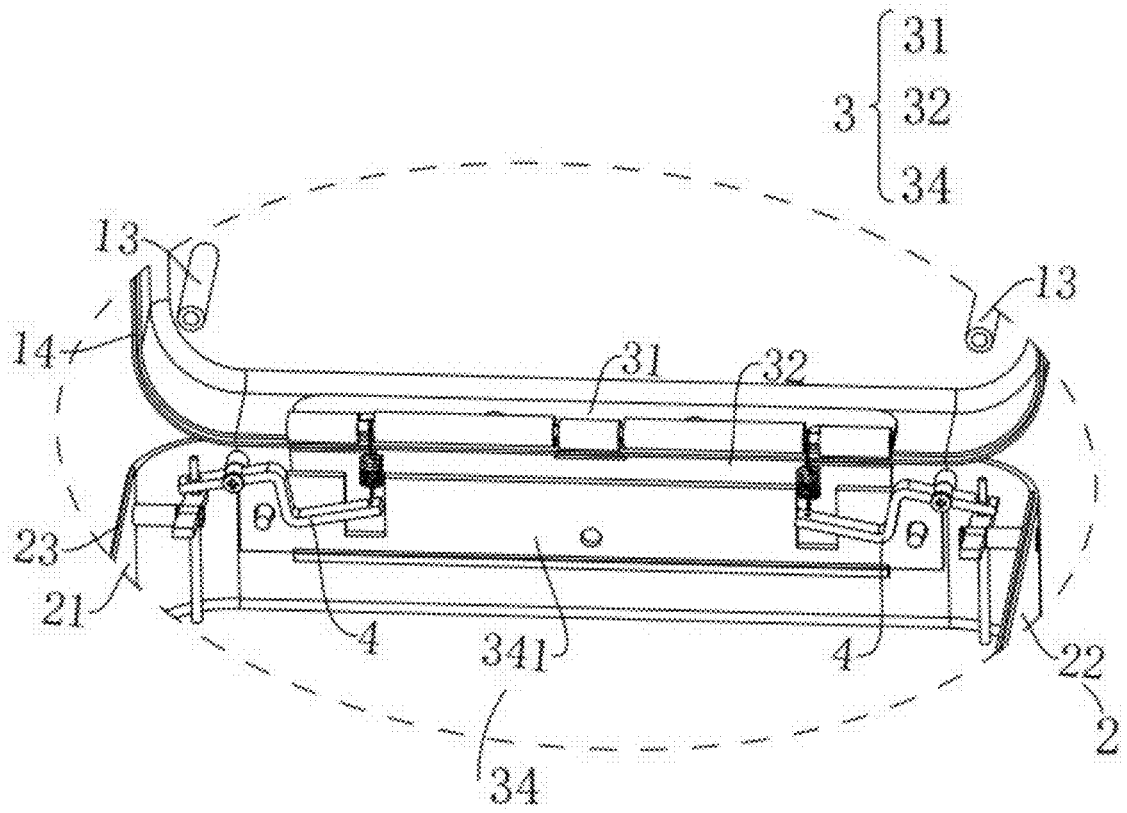
FIG. 9 shows an enlarged view of a portion C in FIG. 8.

Referring to FIGS. 2 and 7, in one embodiment, the bearing member 43 may include a sleeve 432, a pressing rod 433, and an elastic member 434. The sleeve 432 may be arranged as a hollow columnar structure with a receiving cavity 4321 formed inside. The sleeve 432 may be arranged vertically or substantially vertically on the box body 2. The pressing rod 433 may be movably inserted in the receiving cavity 4321, and the pressing rod 433 may move up and down along the receiving cavity 4321. The pressing rod 433 may include the first end 41 and the first connection end 431. That is, each of the first end 41 and the first connection end 431 may further be a respective one of two ends of the pressing rod 433. The first end 41 of the pressing rod 433 may extend through the sleeve 432 towards the cover body 1. The elastic member 434 may be arranged between the first end 41 and the first connection end 431. The elastic member 434 may be a spring, an elastic piece, or the like. The elastic member 434 may include two ends. One of the two ends of the elastic member 434 may abut against a top end of the sleeve 432, and the other of the two ends may abut against the first connection end 431 of the pressing rod 433. When the cover body 1 presses down on the first end 41, the pressing rod 433 may as a whole move downward, the elastic member 434 may elastically stretch, and the first connection end 431 may also move downward. At this time, the first connection end 431 may drive the second connection end 441 to move through a change in position, thereby causing the second end 42 to pull down the cover body 1. When the cover body 1 releases the first end 41, the elastic member 434 may contract and reset, the elastic member 434 may drive the first connection end 431 to reset, and the first connection end 431 may also reset, at which time the cover body 1 may reopen.

Referring to FIGS. 5 and 10, in another embodiment, the bearing member 43 may include a lever 435 and a connecting shaft 436. The connecting shaft 436 may be arranged on the first side wall 21 or the second side wall 22 of the box body 2. The lever 435 may include the first end 41 and the first connection end 431. That is, each of the first end 41 and the first connection end 431 may specifically be a respective one of two ends of the lever 435. A middle portion of the lever 435 between the first end 41 and the first connection end 431 may rotatably sleeve the connecting shaft 436, and the first end 41 and the first connection end 431 may rotate in opposite directions. When the cover body 1 presses down on the first end 41, the first end 41 may rotate downward, and the first connection end 431 may rotate upward in response, driving the second connection end 441 to move through a positional change of the first connection end 431, thereby causing the second end 42 to pull down the cover body 1.

As shown in FIGS. 2 and 5, in the two embodiments of the bearing member 43, the conversion member 44 may include a flexible connecting member 442 and at least one steering member 443. The flexible connecting member 442 may include the second connecting end 441 and the second end 42. That is, each of the second connecting end 441 and the second end 42 may be a respective one of two ends of the flexible connecting member 442. The flexible connecting member 442 may be a pull rope. The at least one steering member 443 may be at least one steering wheel 4431 or at least one limiting shaft 4432, and the steering wheel 4431 and the limiting shaft 4432 may be arranged on the first side wall 21 or the second side wall 22. The second connecting end 441 of the flexible connecting member 442 may extend around the steering wheel 4431 or the limiting shaft 4432 and is connected to the first connecting end 431 of the bearing member 43. The steering wheel 4431 and the limiting shaft 4432 may change an extension direction of the second connecting end 441, thereby changing a force direction of the second end 42. The number of the at least one steering wheel 4431 and the number of the at least one limiting shaft 4432 may be set according to a movement direction of the first connecting end 431.

It may be understood that the second end 42 of the flexible connecting member 442 may pull down the cover body 1. When the flexible connecting member 442 cooperates with the pressing rod 433 described above, the first connecting end 431 of the pressing rod 433 may move downward. In this case, the number of the at least one steering wheel 4431 or the number of the at least one limiting shaft 4432 may be two. The second connecting end 441 may first pass under one of the two steering wheels 4431 or the two limiting shafts 4432, and then passes over the other of the two steering wheels 4431 or the two limiting shafts 4432 to be connected with the first connecting end 431. The first connecting end 431 of the pressing rod 433 may define a plurality of holes to facilitate penetration and fixation of the flexible connecting member 442. When the flexible connecting member 442 cooperates with the lever 435 described above, the first connecting end 431 of the lever 435 may rotate upward. In this case, the number of the at least one steering wheel 4431 or the number of the at least one limiting shaft 4432 may be one, and the second connecting end 441 may extend under the one steering wheel 4431 or the one limiting shaft 4432 to be connected with the first connecting end 431.

In one embodiment, as shown in FIGS. 2 and 5, the cover body 1 may be arranged with at least one receiving column 12. Each receiving column 12 is located at a corner of the cover body 1. The receiving column 12 may define an opening towards the flexible connecting member 442. The second end 42 of the flexible connecting member 442 may pass through the opening of the receiving column 12 and may be engaged with the receiving column 12 to ensure a stable connection between the flexible connecting member 442 and the cover body 1.

As shown in FIG. 10, when the bearing member 43 includes a lever 435, the conversion member 44 may cooperatively include a crankshaft 444. The crankshaft 444 may include the second connection end 441 and the second end 42. That is, in this case, each of the second connection end 441 and the second end 42 may be a respective one of two ends of the crankshaft 444. A portion of the crankshaft 444 between the second connection end 441 and the second end 42 may be rotatably mounted on the first side wall 21 or the second side wall 22 of the box body 2 through the connecting shaft 436. The second connection end 441 and the second end 42 of the crankshaft 444 may rotate in opposite directions. The second connection end 441 of the crankshaft 444 and the first connection end 431 of the lever 435 may be arranged vertically. Specifically, the transmission assembly 4 may further include a guide rod 446, and the guide rod 446 may be arranged vertically. Each of the second connection end 441 and the first connection end 431 may movably sleeve a periphery of the guide rod 446 vertically. When the cover body 1 presses down on the first end 41 of the lever 435, the first connection end 431 of the lever 435 may move upward, and the first connection end 431 may drive the second connection end 441 to move upward, thereby causing the second end 42 of the crankshaft 444 to pull down the cover body 1. The conversion member 44 may further include a connecting member 445. The connecting member 445 may be a spring, a pull rope, or a connecting rod. The connecting member 445 may connect the second end 42 of the crankshaft 444 with the cover body 1 or the hinge 3 described below.

In one embodiment of the present disclosure, as shown in FIGS. 1, 3, 8, 11, and 12, the hinge 3 may be arranged in an interior space of the cover body 1 and an interior space of the box body 2 and may connect the cover body 1 with the box body 2, to prevent others from damaging the hinge 3 and opening the storage box from an exterior of the storage box. The hinge 3 may include a first connecting portion 31 and a second connecting portion 32 which may be hinged to each other. The first connecting portion 31 may be arranged on the cover body 1, and the second connecting portion 32 may be arranged on the box body 2, so that the box body 2 and the cover body 1 may rotate open and close relative to each other. The hinge 3 may be a butt hinge, and each of the first connecting portion 31 and the second connecting portion 32 may be a respective one of two leaves of the butt hinge. The second connecting portion 32 may be movable along a thickness direction of the box body 2. During the opening process of the cover body 1, the second connecting portion 32 may move upward along the box body 2 to increase a gap between the cover body 1 and the box body 2, forming a rotating space to facilitate the opening of the cover body. During the closing process of the cover body 1, the second connecting portion 32 may move downward along the box body 2, so that the gap between the cover body 1 and the box body 2 may gradually disappear until the cover body 1 and the box body 2 are seamlessly closed.

In one embodiment of the present disclosure, as shown in FIGS. 1, 4, 8, 11, and 12, the hinge 3 may further include a rotating shaft 33. Each of an end of the first connecting portion 31 and an end of the second connecting portion 32 which may face the end of the first connecting portion 31 may be arranged with a shaft sleeve. Each of the first connecting portion 31 and the second connecting portion 32 may rotatably sleeve the rotating shaft 33 through the shaft sleeve of the respective one of the first connecting portion 31 and the second connecting portion 32. Each of the first connecting portion 31 and the second connecting portion 32 may rotate relative to the rotating shaft 33. The second end 42 of the transmission assembly 4 may be connected to any one of the cover body 1, the rotating shaft 33, the first connecting portion 31, and the second connecting portion 32. When the second end 42 of the transmission assembly 4 is connected to the cover body 1, the second end 42 may directly act on the cover body 1 to apply the pulling force. When the second end 42 of the transmission assembly 4 is connected to the rotating shaft 33, the first connecting portion 31, or the second connecting portion 32, the second end 42 may indirectly act on the cover body 1 to apply the pulling force through the rotating shaft 33, the first connecting portion 31, or the second connecting portion 32, all of which may achieve a purpose of pulling down the cover body 1.

In one embodiment of the present disclosure, as shown in FIG. 2, the cover body 1 may include a first end wall 11, the first connecting portion 31 may be arranged on the first end wall 11, and the second end 42 of the transmission assembly 4 may be connected to a portion of the cover body 1 close to the first end wall 11. That is, when the second end 42 of the transmission assembly 4 is connected to the cover body 1, the second end 42 of the transmission assembly 4 may be connected to the portion of the cover body 1 close to the first end wall 11. Since the second connecting portion 32 is slidable, in this way, others may be prevented from prying open the storage box from the gap near the hinge 3.

In one embodiment of the present disclosure, as shown in FIGS. 1, 2, 8, 11, and 12, the hinge 3 may further include a limiting member 34. When the second connecting portion 32 moves to a maximum distance towards the cover body 1, the limiting member 34 may limit the second connecting portion 32, to prevent the second connecting portion 32 from moving beyond a travel limit, causing a misalignment between the cover body 1 and the box body 2, which may affect the user's next closing operation.

Specifically, the limiting member 34 may include a limiting plate 341. The box body 2 may include a second end wall 24, and the second connecting portion 32 may be mounted on the second end wall 24. The limiting plate 341 may be arranged spaced apart from the second end wall 24, and the second connecting portion 32 may be movably arranged between the limiting plate 341 and the box body 2. That is, the limiting plate 341 and the box body 2 may movably clamp the second connecting portion 32, and the second connecting portion 32 may move up and down. One limiting method may be that a bottom end of the second connecting portion 32 may be bent to a hook-shaped member 322. When the second connecting portion 32 moves upward to the maximum distance, the hook-shaped member 322 may abut against the limiting plate 341 to limit the second connecting portion 32. Another limiting method may be that the limiting plate 341 may define a plurality of openings 343. Each of the plurality of openings 343 is vertical strip-shaped. The second connecting portion 32 may be arranged with a plurality of protruding posts 321. Each of the plurality of protruding posts 321 may be arranged protruding from the second connecting portion 32 towards the limiting plate 341. Each of the plurality of protruding posts 321 may move in a respective one of the plurality of openings 343. When the second connecting portion 32 moves upward to the maximum distance, the protruding post 321 may move to a top end of the opening 343 and may be limited by the limiting plate 341. When the second connecting portion 32 moves downward to the maximum distance, the protruding post 321 may move to a bottom end of the opening 343 and may be limited by the limiting plate 341. A cooperation of the openings 343 and the protruding posts 321 may control an entire travel of the second connecting portion 32, making a movement of the second connecting portion 32 more stable.

In one embodiment of the present disclosure, as shown in FIG. 1, when the cover body 1 and the box body 2 are in an open state, a gap 25 may be left between the first connecting portion 31 and the second connecting portion 32 for a rotation of the rotating shaft 33, so that the cover body 1 and the box body 2 may rotate and open relative to each other. The maximum distance that the second connecting portion 32 moves towards the cover body 1, i.e., a maximum upward movement distance of the second connecting portion 32, may be greater than or equal to a width of the gap 25, so that the rotating shaft 33 may have sufficient rotation space after the second connecting portion 32 moves.

Figure 11:
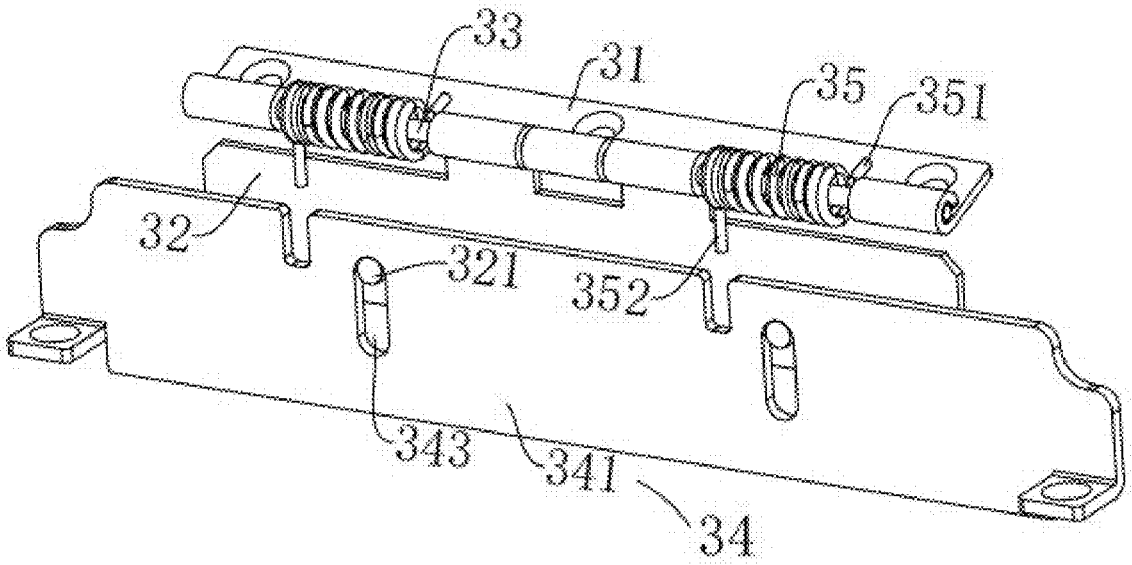
FIG. 11 shows a structural view of a hinge according to an embodiment of the disclosure.
Figure 12:
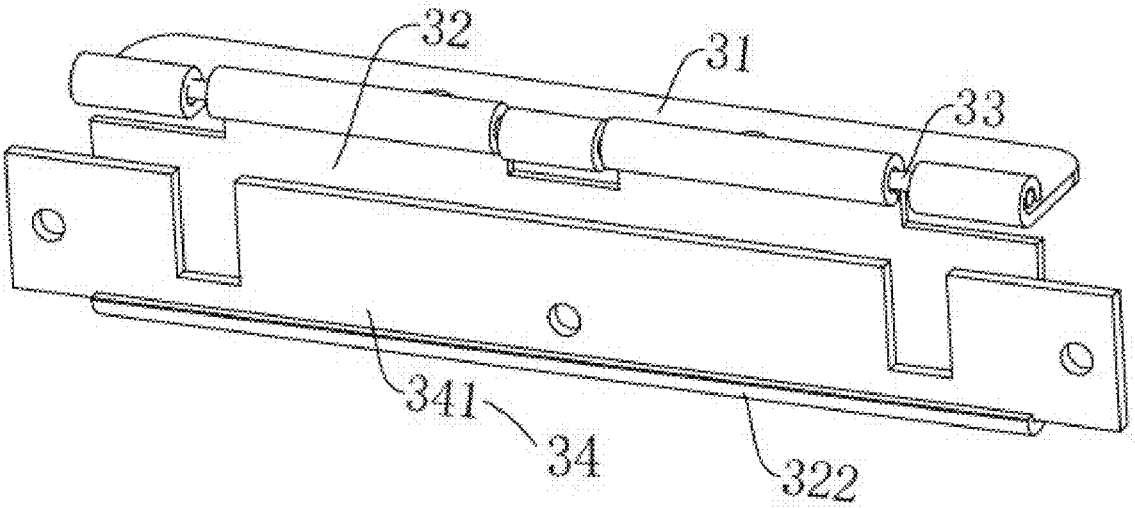
FIG. 12 shows a structural view of another hinge according to an embodiment of the disclosure.

In one embodiment of the present disclosure, as shown in FIG. 11, the hinge 3 may further include at least one torsion spring 35. The torsion spring 35 may sleeve a periphery of the rotating shaft 33. The torsion spring 35 may include a first arm 351 and a second arm 352. Each of the first arm 351 and the second arm 352 may be connected to a respective one of the first connecting portion 31 and the second connecting portion 32, or each of the first arm 351 and the second arm 352 may be connected to a respective one of the cover body 1 and the box body 2. A length of the first arm 351 and a length of the second arm 352 may be arranged to satisfy that no matter how the gap between the cover body 1 and the box body 2 changes, each of the first arm 351 and the second arm 352 may abut against the respective one of the first connecting portion 31 and the second connecting portion 32, or each of the first arm 351 and the second arm 352 may abut against the respective one of the cover body 1 and the box body 2. Once the opening process of the cover body 1 starts, the elastic member 434 in the sleeve 432 may reset and push up the pressing rod 433, and at this time the torsion spring 35 may also reset, causing the first arm 351 and the second arm 352 to push open the cover body 1. That is, after the user unlocks the storage box, the cover body 1 may automatically pop open, which is convenient for the user to use.

In one embodiment of the present disclosure, as shown in FIGS. 1 and 2, the cover body 1 may be arranged with a pressing member 13 protruding from the cover body 1 towards the box body 2, and the pressing member 13 may press down on the first end 41 during the rotation and closing process of the cover body 1. During the closing process of the cover body 1, the pressing member 13 may abut against the first end 41 of the bearing member 43, and a pressure applied by the pressing member 13 may trigger a subsequent transmission action.

In one embodiment of the present disclosure, as shown in FIG. 2, the cover body 1 may be arranged with an upper stop 14 at the lower edge 15, and the box body 2 may be arranged with a lower stop 23 at the upper edge 27. The upper stop 14 and the lower stop 23 may be engaged with each other. The upper stop 14 and the lower stop 23 may be formed as a pair of convex and concave structures, which may abut against and may be engaged with each other when the cover body 1 is closed, thereby enabling a seamless and tight closure between the cover body 1 and the box body 2.

Figure 4:
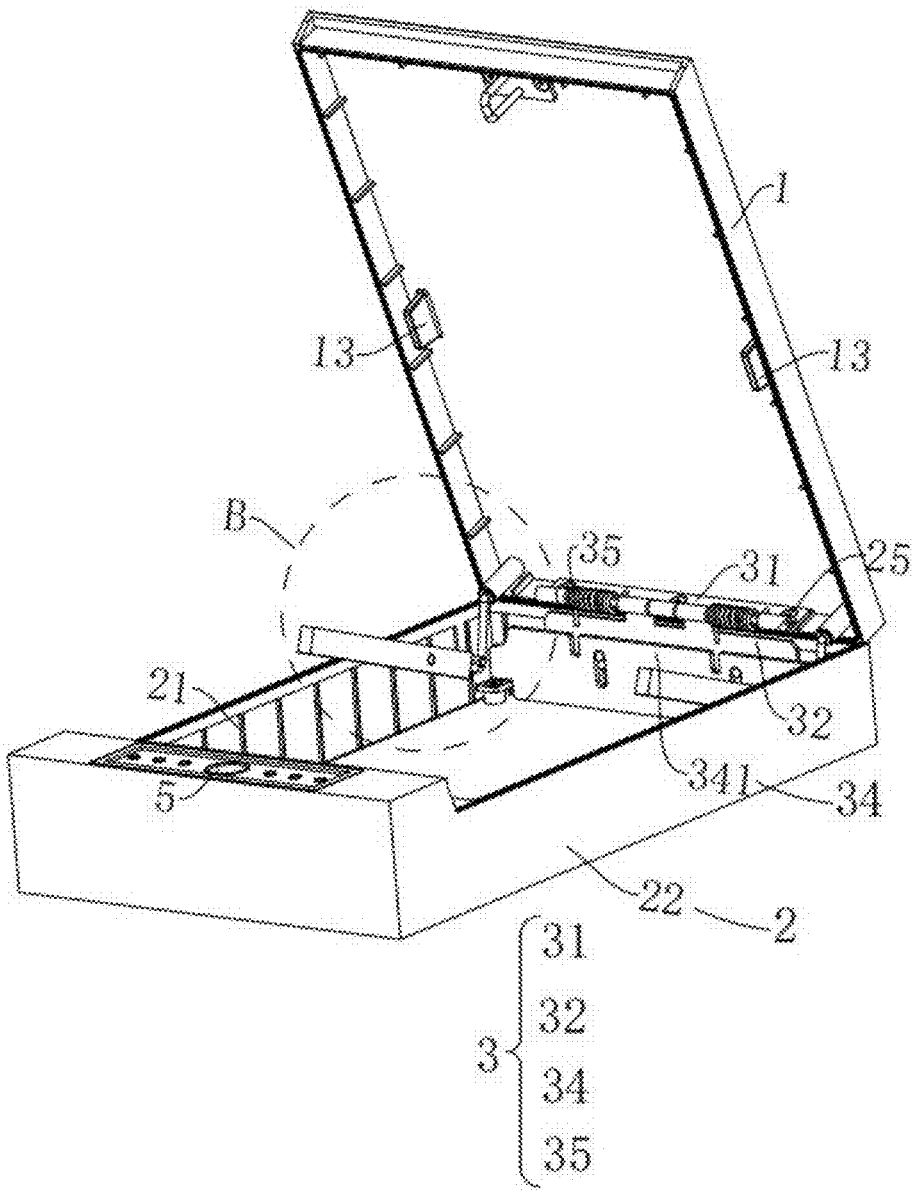
FIG. 4 shows a structural view of another storage box according to an embodiment of the disclosure.
Figure 13:
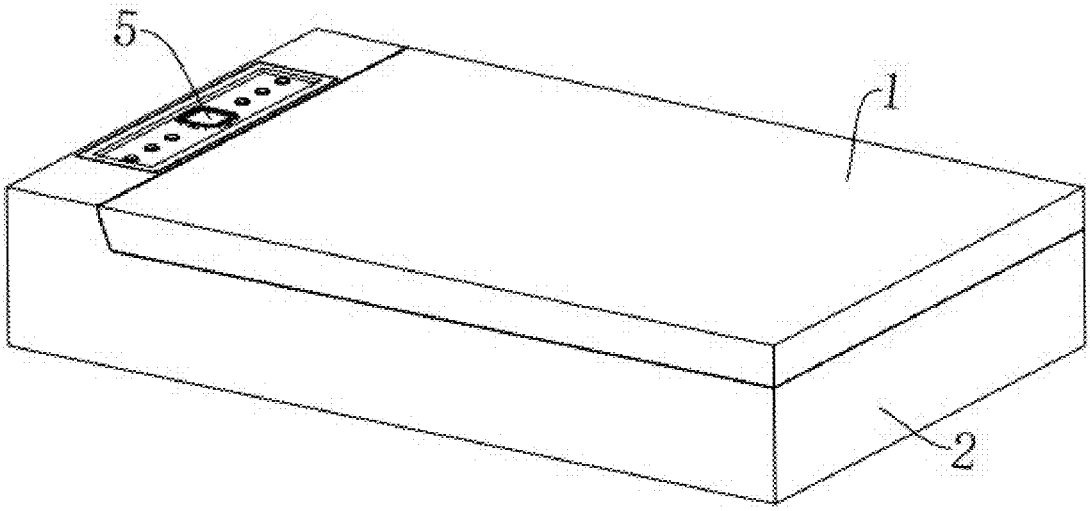
FIG. 13 shows a structural view of the storage box in a closed state according to an embodiment of the disclosure.

In one embodiment of the present disclosure, as shown in FIGS. 4 and 13, the storage box may further be arranged with at least one locking member 5 for locking or unlocking the cover body 1 and the box body 2. The at least one locking member 5 may be one biometric lock, mechanical key lock, password lock, or Bluetooth lock, or more than one mutually cooperated biometric locks, mechanical key locks, password locks, or Bluetooth locks. The locking member 5 may be arranged away from the transmission assembly 4, so that each of the locking member 5 and the transmission assembly 4 may fix a respective one of two ends of the storage box when the cover body 1 is closed, further improving the safety performance of the storage box.

The storage box in the present disclosure may include a cover body 1, a box body 2, and at least one transmission assembly 4. The cover body 1 may rotate to open and close relative to the box body 2. The at least one transmission assembly 4 may include a first end 41 and a second end 42. The first end 41 and the second end 42 may be arranged in a force-transmissible relationship. During a closing process of the cover body 1, the cover body 1 may act on the first end 41, and the first end 41 of the transmission assembly 4 may convert and transmit a force from the cover body 1 to the second end 42; the second end 42 may pull the cover body 1 until the cover body 1 abuts against the box body 2, at which point the cover body 1 and the box body 2 are tightly closed. The at least one transmission assembly 4 may continuously tighten the cover body 1 after the cover body 1 is closed, eliminating a gap between the cover body 1 and the box body 2 to prevent others from prying open the storage box from the outside, thereby improving the safety performance of the storage box.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

The invention claimed is:

1. A storage box, comprising:

a cover body;

a box body, wherein the cover body and the box body are configured to open and close relative to each other; when the box body and the cover body are closed to each other, an inner space for storage is formed cooperatively by the box body and the cover body; and at least one transmission assembly, arranged in the box body and received inside the inner space, wherein the at least one transmission assembly is inaccessible to any user when the box body being closed to the cover body; the at least one transmission assembly comprises a first end and a second end, wherein the first end and the second end are arranged in a force-transmissible relationship, and during a closing process of the cover body, an inner side of the cover body facing the inner space acts on the first end, and the second end of the at least one transmission assembly pulls the cover body, enabling the cover body to abut against the box body;

wherein, a pressing portion and a pull portion are arranged on the inner side of the cover body; the pressing portion and the pull portion are spaced apart from each other; an end of the pull portion is directly connected to the second end of the at least one transmission assembly; the other end of the pull portion is fixedly connected to the inner side of the cover body;

during the closing process of the cover body, the pressing portion presses the first end of the at least one transmission assembly, and the second end of the at least one transmission assembly pulls the cover body via the pull portion.

2. The storage box according to claim 1, wherein the number of the at least one transmission assembly is two, the box body comprises a first side wall and a second side wall, the first side wall and a second side wall are arranged along a length direction of the box body, and each of the two transmission assemblies is arranged close to a respective one of the first side wall and the second side wall.

3. The storage box according to claim 1, wherein the at least one transmission assembly comprises:

a bearing member, comprising the first end and a first connection end; and a conversion member, comprising a second connection end and the second end, wherein the second connection end is connected to the first connection end, and when the cover body presses down on the first end, the first connection end drives the second connection end to move, enabling the second end to pull down the cover body.

4. The storage box according to claim 3, the bearing member comprises:

a sleeve, wherein an interior of the sleeve defines a receiving cavity;

a pressing rod, accommodated in the receiving cavity, wherein the pressing rod comprises the first end and the first connection end, and the first end extends through the sleeve towards the cover body; and an elastic member, arranged between the first end and the first connection end; when the cover body presses down on the first end, the elastic member stretches, and the first connection end moves downward; when the cover body releases the first end, the elastic member contracts, and the first connection end resets.

5. The storage box according to claim 3, wherein the bearing member comprises a lever, the lever comprises the first end and the first connection end, and when the cover body presses down on the first end, the first connection end moves upward.

6. The storage box according to claim 5, wherein the conversion member comprises a crankshaft, the crankshaft comprises the second connection end and the second end, the second connection end of the crankshaft and the first connection end of the lever are arranged vertically, and when the cover body presses down on the first end, the first connection end drives the second connection end to move upward, enabling the second end of the crankshaft to pull down the cover body.

7. The storage box according to claim 6, wherein the conversion member further comprises a connecting member, the connecting member is configured as a spring, a pull rope, or a connecting rod, and the connecting member is configured to drive the cover body to move through the second end.

8. The storage box according to claim 3, wherein the conversion member comprises:

a flexible connecting member, comprising the second connection end and the second end; and at least one steering member, wherein the second connection end passes around the at least one steering member and is connected to the first connection end of the bearing member, and the at least one steering member is configured to change an extension direction of the second connection end; wherein the at least one steering member is configured as at least one steering wheel or at least one limiting shaft.

9. The storage box according to claim 8, wherein the pull portion arranged on the cover body is a receiving column, and the second end of the flexible connecting member is engaged with the receiving column.

10. The storage box according to claim 1, wherein the storage box further comprises a hinge, and the hinge is arranged in the cover body and the box body and connects the cover body and the box body;

the hinge comprises a first connecting portion and a second connecting portion, the first connecting portion and the second connecting portion are hinged to each other;

the first connecting portion is arranged on the cover body, and the second connecting portion is arranged on the box body, and the second connecting portion is movable along a thickness direction of the box body.

11. The storage box according to claim 10, wherein the hinge further comprises a rotating shaft, each of the first connecting portion and the second connecting portion sleeves a periphery of the rotating shaft;

the second end of the at least one transmission assembly is connected to any one of the cover body, the rotating shaft, the first connecting portion, and the second connecting portion.

12. The storage box according to claim 11, wherein the hinge further comprises at least one torsion spring, the at least one torsion spring sleeves a periphery of the rotating shaft, the at least one torsion spring comprises a first arm and a second arm, each of the first arm and the second arm is connected to a respective one of the first connecting portion and the second connecting portion, or each of the first arm and the second arm is connected to a respective one of the cover body and the box body.

13. The storage box according to claim 10, wherein the cover body comprises a first end wall, the first connecting portion is arranged on the first end wall, and the second end of the at least one transmission assembly is connected to a portion of the cover body close to the first end wall.

14. The storage box according to claim 10, wherein the hinge further comprises a limiting member, and when the second connecting portion moves to a maximum distance towards the cover body, the limiting member limits the second connecting portion.

15. The storage box according to claim 14, wherein the limiting member comprises a limiting plate, the limiting plate is arranged spaced apart from the box body, the second connecting portion is movably arranged between the limiting plate and the box body, and the limiting plate is configured to limit the second connecting portion.

16. The storage box according to claim 10, wherein when the cover body and the box body are in an open state, a gap is formed between the first connecting portion and the second connecting portion for a relative rotation between the cover body and the box body, and the maximum moving distance of the second connecting portion towards the cover body is greater than or equal to a width of the gap.

17. The storage box according to claim 1, wherein the pressing portion arranged on the cover body is a pressing member protruding from the cover body towards the box body, and the pressing member presses down on the first end during the closing process of the cover body.

18. The storage box according to claim 1, wherein the cover body is arranged with an upper stop at a lower edge of the cover body, and the box body is arranged with a lower stop at an upper edge of the box body, and when the cover body is closed, the upper stop and the lower stop are engaged with each other.

19. The storage box according to claim 1, wherein the storage box is further arranged with a locking member for locking or unlocking the cover body and the box body, and the locking member is arranged away from the at least one transmission assembly.

20. The storage box according to claim 1, wherein during the closing process of the cover body, the inner side of the cover body facing the inner space applies a pressing force on the first end, and the second end of the at least one transmission assembly applies a pulling force to pull the cover body, enabling the cover body to abut against the box body; wherein the pressing force and the pulling force are both applied in a direction that is towards an interior of the box body.

* * * * *